US009636603B2

(12) United States Patent
Wang

(10) Patent No.: US 9,636,603 B2
(45) Date of Patent: May 2, 2017

(54) HAND-HELD CRACKER SNAP SPRAYING PROJECTILE

(71) Applicant: Yu-Jen Wang, Taichung (TW)

(72) Inventor: Yu-Jen Wang, Taichung (TW)

( * ) Notice: Subject to any disclaimer, the term of this patent is extended or adjusted under 35 U.S.C. 154(b) by 0 days.

(21) Appl. No.: 14/876,829

(22) Filed: Oct. 7, 2015

(65) Prior Publication Data

US 2016/0339353 A1 Nov. 24, 2016

(30) Foreign Application Priority Data

May 20, 2015 (CN) ..... 2015 2 0326434 U

(51) Int. Cl.
*A63H 37/00* (2006.01)
*F41B 11/24* (2006.01)
*F41B 11/66* (2013.01)

(52) U.S. Cl.
CPC ..... *A63H 37/00* (2013.01); *F41B 11/66* (2013.01)

(58) Field of Classification Search
CPC ..... A63H 37/00; F41B 11/66
See application file for complete search history.

(56) References Cited

U.S. PATENT DOCUMENTS 5,015,211 A * 5/1991 Reveen ..... A63H 37/00 124/74
5,338,242 A * 8/1994 Cheng ..... A63H 37/00 446/183
5,471,968 A * 12/1995 Lee ..... F41B 11/89 124/59
5,634,840 A * 6/1997 Watkins ..... A63H 37/00 446/475
8,876,574 B2 * 11/2014 Bourdelaise ..... A63H 37/00 446/399
2006/0199469 A1 * 9/2006 Du ..... A63H 37/00 446/475
2008/0311822 A1 * 12/2008 Kim ..... A63H 37/005 446/475

* cited by examiner

*Primary Examiner* — John Ricci

(57) ABSTRACT

A hand-held cracker snap for spraying projectile includes a main unit, a button, a disk, an air cylinder and a nozzle. The button is loosely disposed in the main unit. The disk is disposed in the main unit and is connected to the button. The air cylinder is disposed in the main unit and is provided with a central tube that can be extended or compressed along an axis repeatedly to suck or squeeze air to or from the air cylinder. The nozzle is a tubular element in the connecting pipe. An end of the nozzle is connected to the interior part of the air cylinder, allowing air to enter or exit the air cylinder via the nozzle. The nozzle guides air into the bullet.

7 Claims, 8 Drawing Sheets

HAND-HELD CRACKER SNAP SPRAYING PROJECTILE

BACKGROUND OF THE INVENTION

1. Field of the Invention

The present invention relates to a toy and, more particularly, to a hand-held cracker snap which is used to spray projectile such as confetti, colored ribbons or colored scrap of paper from a bullet.

2. Description of the Prior Art

It is common to use cracker snaps to spray confetti or any other proper projectile for celebration in an activity, such as a wedding or a festival. However, a typical cracker snap is operated by one person and there is no interaction among between the person and other persons who attend the activity.

SUMMARY OF THE INVENTION

The primary object of the present invention is to provide a hand-held cracker snap for spraying projectile from a bullet.

To achieve the above-mentioned objective, the hand-held cracker snap includes a main unit, a button, a disk, an air cylinder and a nozzle. An aperture is made in an upper end of the main unit. An annular restraint is formed on the wall of the aperture. A connecting pipe extends from a lower portion of the main unit in a radial manner. An annular stop is formed on an internal face of the connecting pipe. The button is a tubular element with a closed end. The button is loosely disposed in the aperture. The button includes a top plate at an upper end and an orifice at a lower end. The top plate is located out of the main unit. The lower end of the button is inserted in the aperture. The disk is inserted in the main unit. The rim of the disk is adjacent to the restraint. The restraint stops the disk in a sense of direction. The disk is in contact with the lower end of the button. The air cylinder is inserted in the main unit. The air cylinder is made of an elastic material. An upper end of the air cylinder is formed with a flat pressure bearing plate. A lower end of the air cylinder is formed with a bottom plate. A central tube is formed between the pressure bearing plate and the bottom plate. The pressure bearing plate is located near a lower face of the disk. The bottom plate is located near an upper face of the base. The central tube is in the form of a bellows so that the air cylinder can be elastically extended or compressed along an axis repeatedly, thereby sucking or squeezing air into or from the air cylinder. The nozzle is a tubular element inserted in the connecting pipe. A first end of the nozzle is connected to a lower portion of the air cylinder and is connected to the interior of the air cylinder to allow air to enter or exit the air cylinder through the nozzle. The first end of the nozzle is located on a side of the annular stop. A second end of the nozzle is located on another side of the annular stop. The second end of the nozzle is formed with a conical guide for guiding a bullet onto the nozzle.

When the hand-held cracker snap is used, the bullet in which the projectile is loaded is inserted into the connecting pipe, and the button is tapped to compress the air cylinder to push air into the bullet through the nozzle, thereby blowing the projectile from the bullet. The air cylinder is disposed in the main unit and is pressed and deformed by the disk, which improves the reliability of the pushing of the air cylinder to spray out the projectile from the bullet. In addition, the main unit isolates and protects the air cylinder from foreign objects that would otherwise puncture the air cylinder.

Other objectives, advantages and features of the present invention will be apparent from the following description referring to the attached drawings.

DETAILED DESCRIPTION OF THE PREFERRED EMBODIMENT

Figure 1:
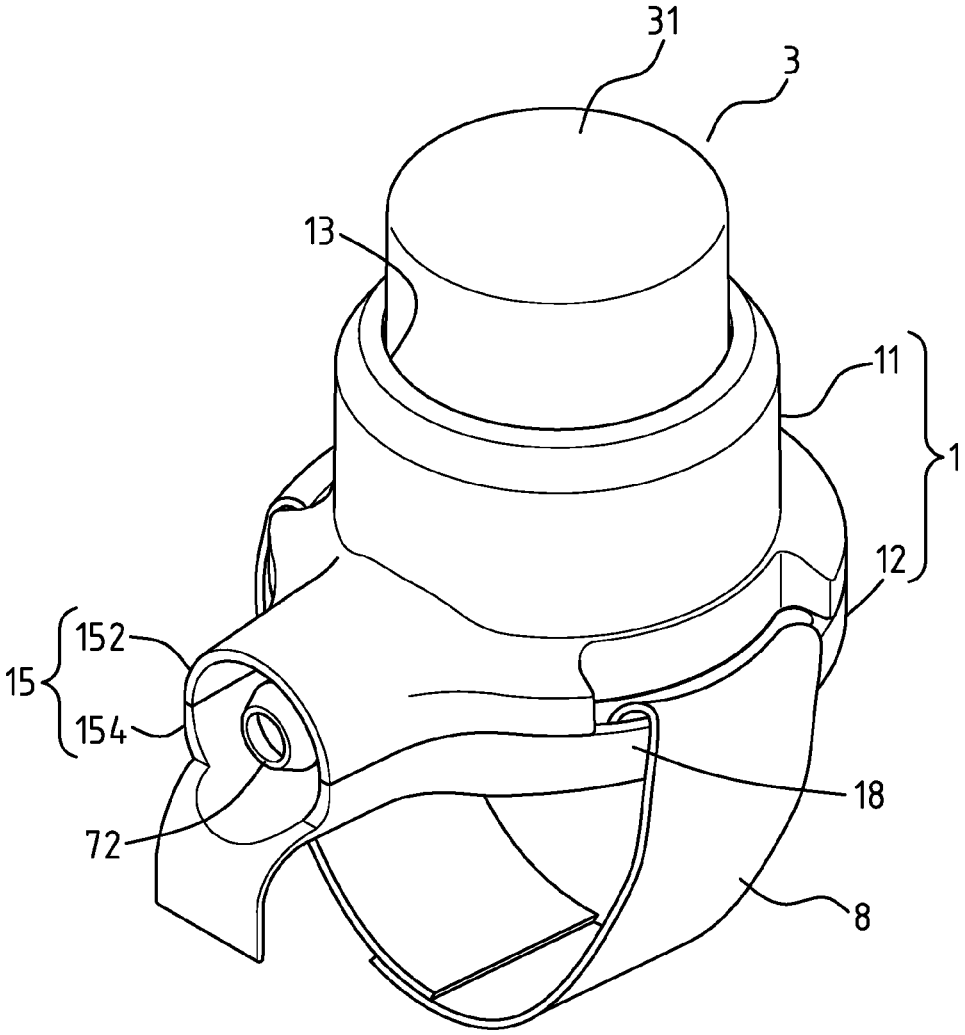
FIG. 1 is a perspective view of a cracker snap according to the preferred embodiment of the present invention.
Figure 2:
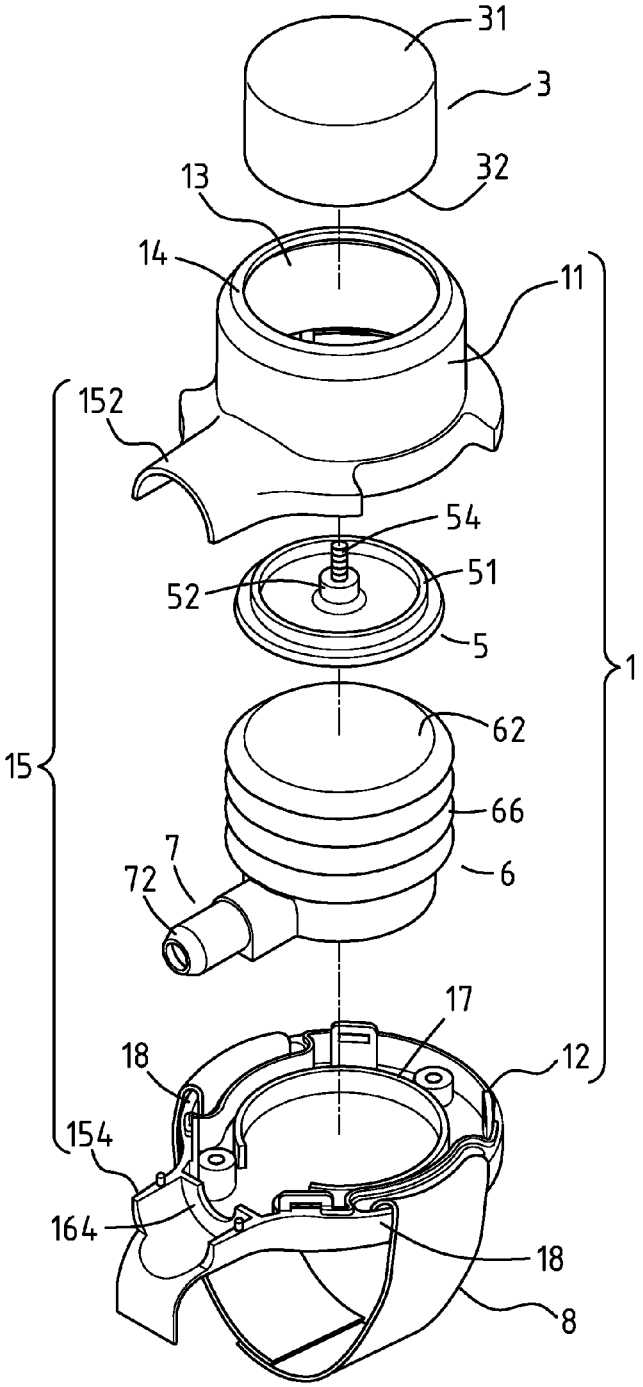
FIG. 2 is an exploded view of the cracker snap shown in FIG. 1.
Figure 3:
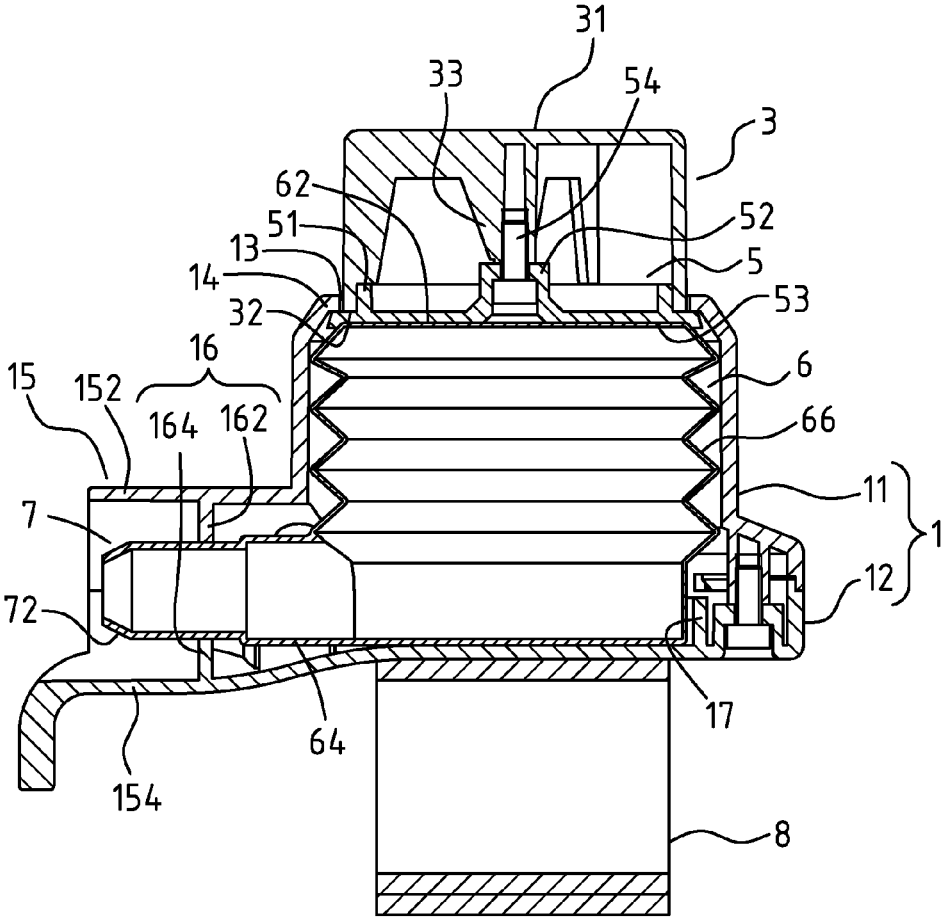
FIG. 3 is a cross-sectional view of the cracker snap shown in FIG. 1.

Referring to FIGS. 1 to 3, a hand-held cracker snap for spraying projectile comprises a main unit 1, a button 3, a disk 5, an air cylinder 6, a nozzle 7 and a band 8 according to the preferred embodiment of the present invention.

Figure 4:
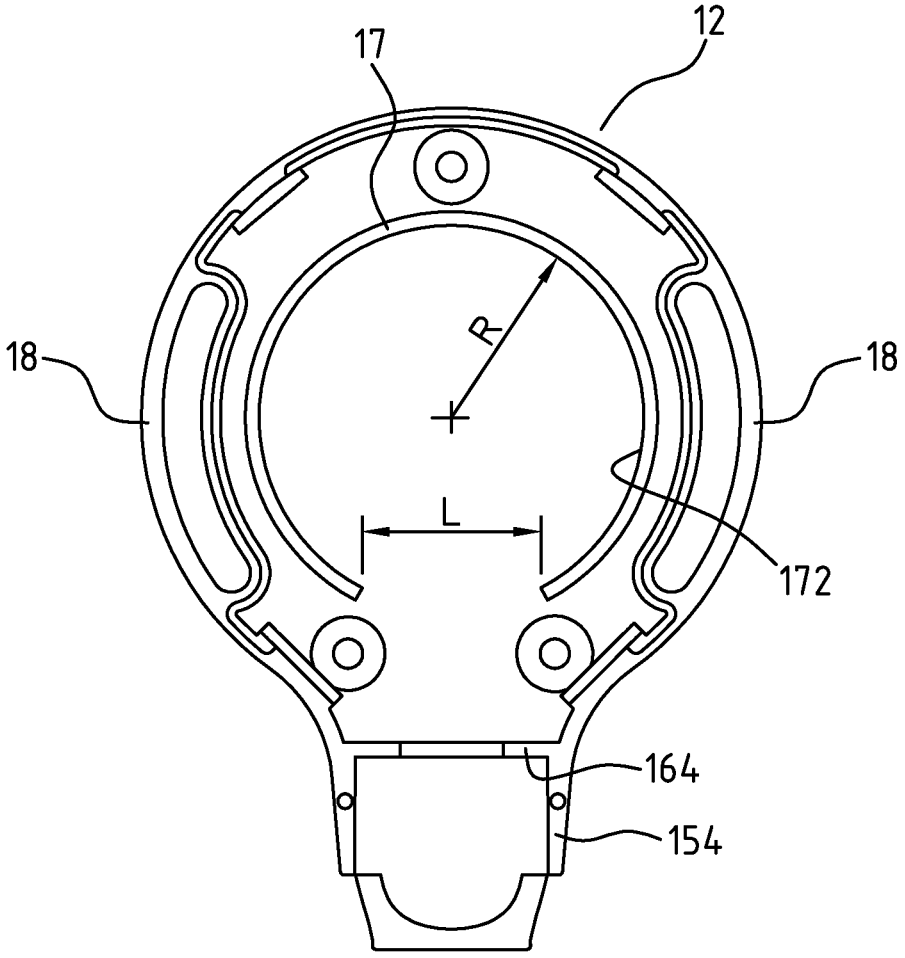
FIG. 4 is a top view of a base of the cracker snap shown in FIG. 1.

The main unit 1 includes a connecting pipe 15 extending from a lower portion and an annular stop 16 extending on an internal face of the connecting pipe 15. In another aspect, the main unit 1 includes a body 11 and a base 12. The body 11 is formed with a first semi-pipe 152. The base 12 is formed with a second semi-pipe 154. The first semi-pipe 152 is connected to the second semi-pipe 154 to constitute the connecting pipe 15. A first arched portion 162 is formed on the first semi-pipe 152. A second arched portion 164 is formed on the second semi-pipe 154. The first arched portion 162 is connected to the second arched portion 164 to constitute the annular stop 16. The body 11 further includes a lower end attached to an upper end of the base 12, an aperture 13 in an upper end, and an annular restraint 14 extending around the aperture 13. The base 12 further includes an arc-shaped wall 17 extending on the upper end thereof. Referring to FIG. 4, the radius of an internal face 172 of the arched wall 17 is R. The distance between two ends of the arched wall 17 is L. L is smaller than 2R. The ends 172 of the arched wall 17 are located between the center of the arched wall 17 and the second semi-pipe 154.

Referring to FIGS. 1 to 3 again, the button 3 is a tubular element inserted in the aperture 13 of the main unit 1. The external diameter of the button 3 is a little smaller than the diameter of the aperture 13. The button 3 includes a top plate 31 at an upper end and an orifice 32 in a lower end. The top plate 31 is located outside the main unit 1. The top plate 31 seals the upper end of the button 3 and is used to take a force exerted by a user. The lower end of the button 3 is inserted in the aperture 13. The interior of the button 3 is provided with a first tube 33 along an axis of the button 3, one end of the first tube 33 is connected to the top plate 31, and the other end of the first tube 33 is pointed at the main unit 1.

The disk 5 is disposed in the main unit 1. The external diameter of the disk 5 is larger than the internal diameter of the aperture 13. A rim of the disk 5 is adjacent to the restraint 14, thereby allowing the restraint 14 to restrict the disk 5 in a sense of direction. The disk 5 is fitted in the orifice 32 of the button 3. The disk 5 includes an annular rib 51 and a second tube 52 on an upper face and a shallow cavity 53 in a lower face. The second tube 52 is formed at the center of the annular rib 51. The annular rib 51 extends into the button 3 through the orifice 32. The circumference of the annular rib 51 is adjacent to an internal face of the button 3 to facilitate positioning the disk 5 relative to the button 3. The second tube 52 includes an end adjacent to an end of the first tube 33. The disk 5 is connected to the button 3 by a threaded bolt 54 which penetrates the second tube 52 axially and is engaged with the first tube 33.

The air cylinder 6 is disposed in the main unit 1 and made of an elastically deformable material. The air cylinder 6 is formed with a pressure bearing plate 62 at an upper end and a bottom plate 64 at a lower end, and a central tube 66 is formed between the pressure bearing plate 62 and the bottom plate 64. The pressure bearing plate 62 is adjacent to the lower face of the disk 5 and is inserted in the shallow cavity 53, preventing lateral movement of the upper end of the air cylinder 6 because the shallow cavity 53 receives and hence confines the upper end of the air cylinder 6. The bottom plate 64 is adjacent to the upper face of the base 12 and located in and hence confined by the arched wall 17, preventing lateral movement of the lower end of the air cylinder 6. The central tube 66 is in the form of a bellows so that the air cylinder 6 can be extended or compressed elastically and repeatedly, thereby sucking air into the air cylinder 6 or squeezing air from the air cylinder 6.

The nozzle 7 is a tubular element extending laterally from a lower section of the air cylinder 6. The nozzle 7 is inserted in the connecting pipe 15. The nozzle 7 is in communication with the air cylinder 6, allowing air to enter or exit the air cylinder 6 via the nozzle 7. The nozzle 7 includes an end inserted in the annular stop 16 and another end formed with a conical guide 72. The guide 72 is used to guide the bullet 9 onto the nozzle 7.

Figure 5:
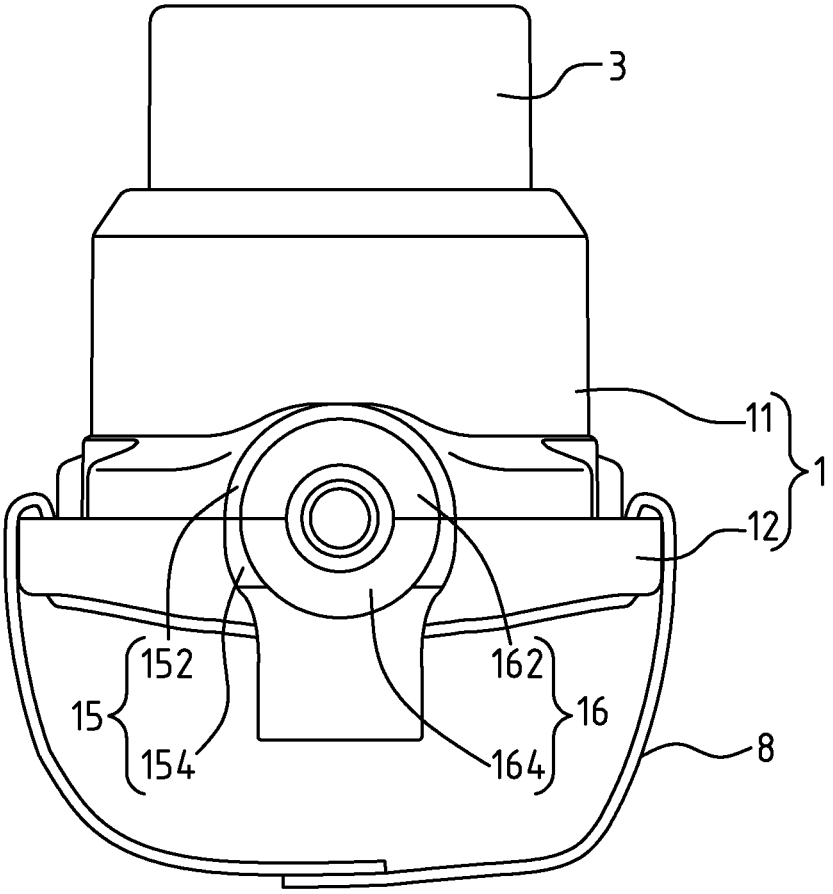
FIG. 5 is a front view of the cracker snap shown in FIG. 1.
Figure 6:
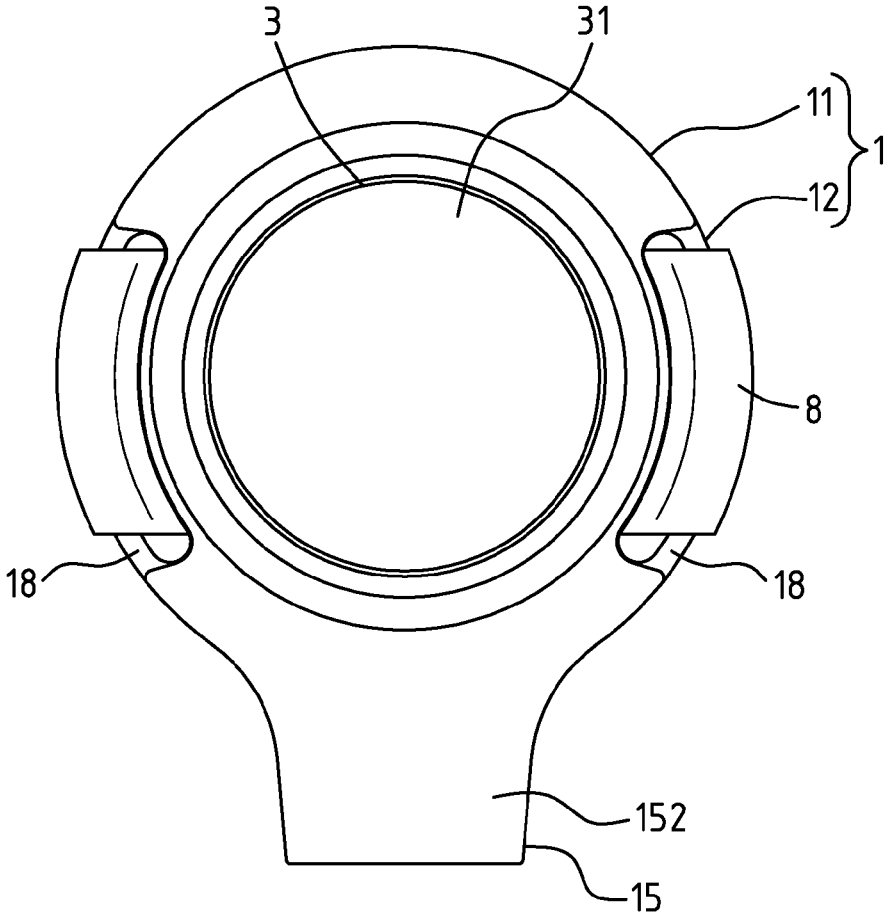
FIG. 6 is a top view of the cracker snap shown in FIG. 1.

As shown in FIG. 1, FIG. 5 and FIG. 6, the main unit 1 includes a hanging rod 18 formed on each of two opposite sides. The band 8 is flexible, the middle section of the band 8 is located below the main unit 1, and the band 8 wraps each hanging rod 18. The band 8 is an optional element used to position the main unit 1 on a palm or other part of the user. Without the band 8, the user can use one hand to hold the main unit 1 and operate the cracker snap to spray the projectile.

In use, at first, the main unit is held in the user's hand, with the base 12 located adjacent to the center of the user's palm. Next, the two ends of the band 8 are joined together at the back of the hand by the fastener. Therefore, the cracker snap can be positioned in the user's hand. In using the cracker snap, the band 8 can be optionally placed at the back of the user's hand.

Figure 7:
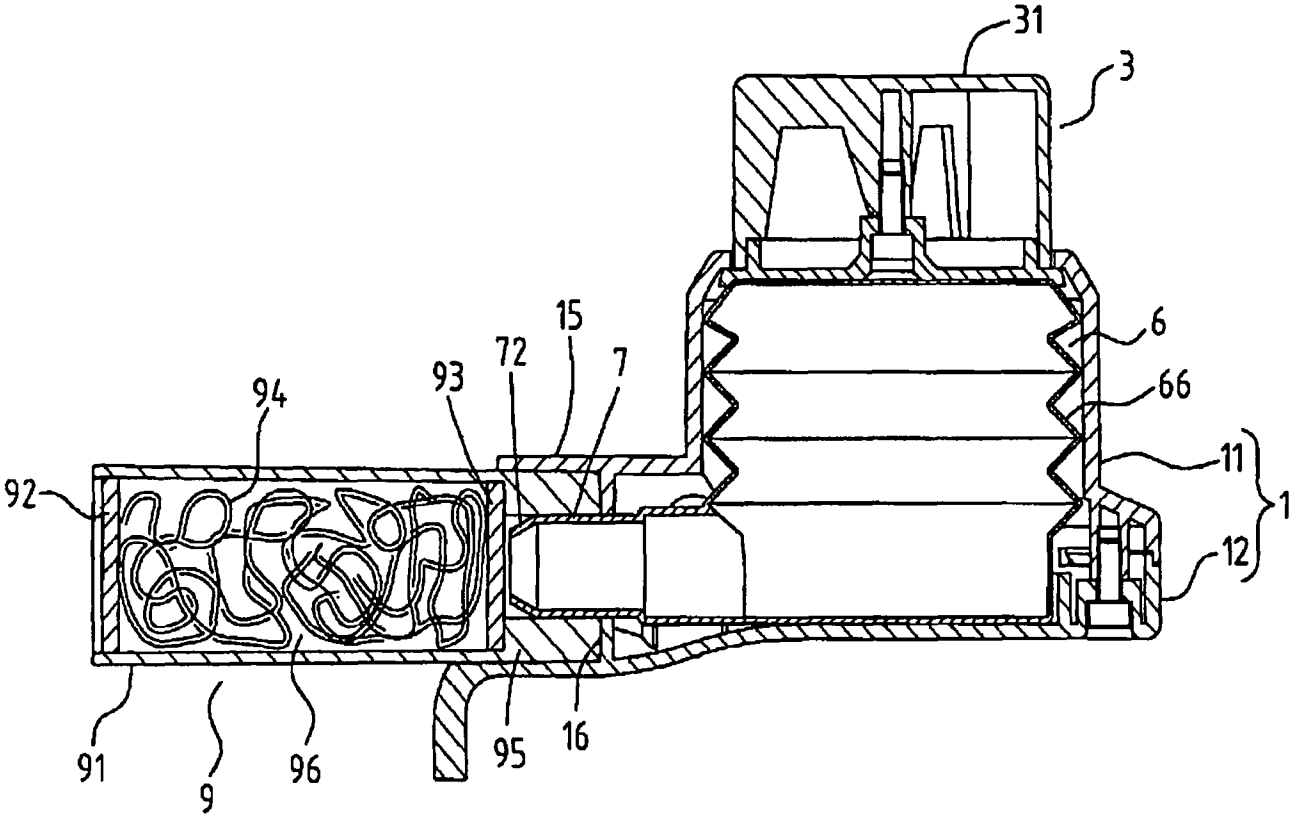
FIG. 7 is a cross-sectional view of the cracker snap used together with a bullet that contains projectile.

As shown in FIG. 7, when the bullet 9 is put in the cracker snap, a rear end of the bullet 9 is inserted into the connecting pipe 15.

The bullet 9 includes a shell 91, a front sealing plate 92, a rear sealing plate 93 and projectile 94. The rear end in the shell 91 is formed with a sleeve 95, and an internal diameter of the sleeve 95 is identical to an external diameter of the nozzle 7, so that the sleeve 95 can be fitted around the nozzle 7. A chamber 96 made in the shell 91 is in communication with a chamber (not numbered) made in the sleeve 95. The front sealing plate 92 and the rear sealing plate 93 are disposed in the chamber 96, and the peripheries of the front sealing plate 92 and the rear sealing plate 93 are in contact with the peripheral wall of the chamber 96. The front sealing plate 92 is adjacent to a front end of the chamber 96, and the rear sealing plate 93 is located at a rear end of the chamber 96 near the sleeve 95 so that the projectile 94 is loaded in the chamber 96 and between the front sealing plate 92 and the rear sealing plate 93.

When the bullet 9 is inserted into the connecting pipe 15, the rear end of the bullet 9 is abutted against the annular stop 16, and the sleeve 95 is fitted around the front end of the nozzle 7. At this time, even if the sleeve 95 does not extend coaxially with the nozzle 7, the sleeve 95 can still be moved onto the front end of the nozzle 7 by the conical guide 72. Moreover, the annular stop 16 abuts against and hence prevents the bullet 9 from getting too deep into the sleeve 15. In addition, there can be a tiny gap between the front end of the nozzle 7 and the rear sealing plate 93 to keep the nozzle 7 away from the rear sealing plate 93.

Figure 8:
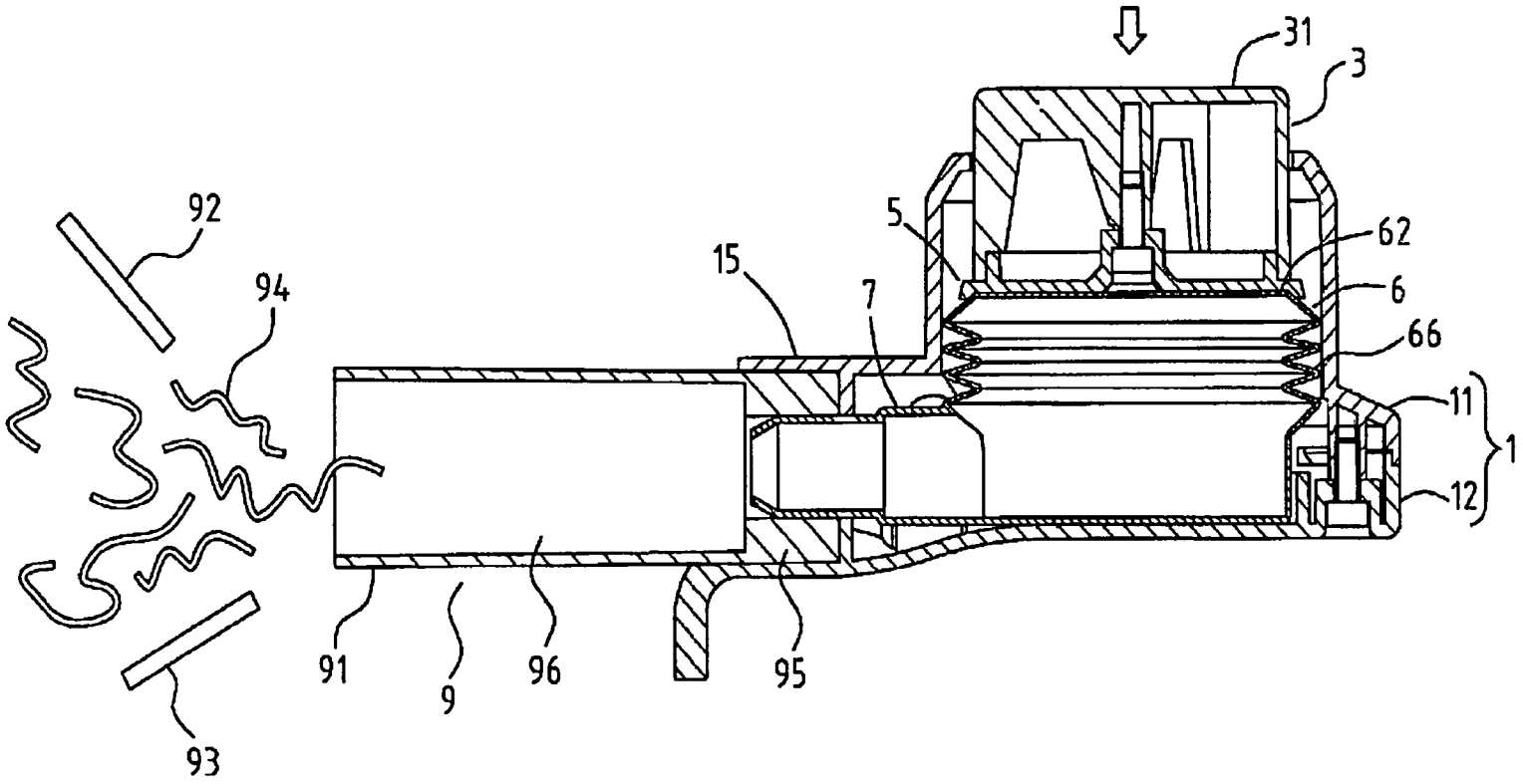
FIG. 8 is a cross-sectional view of the cracker snap and the bullet in another position than shown in FIG. 7.

As shown in FIG. 8, after the rear end of the bullet 9 has been inserted into the connecting pipe 15, the button 3 is tapped to drive the disk 5 to press the air cylinder 6. The air cylinder 6 is squeezed by the disk 5 and the base 12 so that the central tube 66 is deformed elastically along the axis. Air is pumped into the bullet 9 from the air cylinder 6 via the nozzle 7. The air from the air cylinder 6 pushes the rear sealing plate 93 to decrease the volume of the space between the sealing plates 92 and 93 and hence increase the air pressure in the space. The increased air pressure in the space in the space bursts the front sealing plate 92 and the projectile 94 out of the shell 91. The air from the air cylinder 6 might eventually blow the rear sealing plate 93 out of the shell 91.

After the front sealing plate 92, the projectile 94 and the rear sealing plate 93 have flown out of the shell 91, the internal spaces of the chamber 96, the sleeve 95, the nozzle 7 and the air cylinder 6 are still connected to one another, and there is no need to remove the shell 91 out of the connecting pipe 15 to return the button 3 to its original position. The central tube 66 will restore to its initial state due to the elasticity and hence suck air into the air cylinder 6 from the exterior of the shell 91 via the chamber 96, the sleeve 95 and the nozzle 7. In addition, the pressure bearing plate 62 will push the disk 5 and the button 3 back to their original positions. Next, the user removes the shell 91 from the connecting pipe 15, and loads another bullet 9 into the connecting pipe 15 to perform another operation for spraying the projectile 94.

The air cylinder 6 is disposed in the main unit 1 and the button 3 drives the disk 5 to press the air cylinder 6. The applied force with which the disk 5 presses and deforms the air cylinder 6 is distributed to the pressure bearing plate 62, increasing the reliability in squeezing and deforming the air cylinder 6 to push air into the bullet 9 to spray the projectile 94. Besides that, the main unit 1 isolates and hence protects the air cylinder 6 from foreign objects that would otherwise damage the air cylinder 6 to affect the efficiency of squeezing and sucking air through the nozzle 7 by the air cylinder 6.

The user can hold the main unit 1 with one hand and uses the other hand to install the bullet 9, tap the button 3 to spray the projectile 94 and remove the bullet 9. The user can also clap hands with another person, letting the other person to tap the button 3 to accomplish the operation for spraying the projectile 94. If the main unit 1 is chosen to be disposed on an arm, then the user can tap the button 3 by himself or herself, or another person can tap the button 3 to finish the operation for spraying the projectile 94. There are various ways to operate the cracker snap for celebration. It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A hand-held cracker snap comprising:

a main unit comprising an aperture at an upper end, an annular restraint formed on a wall the aperture, a connecting pipe extending from a lower portion, and an annular stop extending on an internal face of the connecting pipe;

a press element comprising an upper end located out of the body, a lower end located in the main unit, a top plate formed at the upper end, and an orifice made in the lower end;

a disk inserted in the main unit and connected to the lower end of the button, wherein the restraint is adapted for abutment against a rim of the disk, thereby restraining the disk in a sense of direction;

an air cylinder inserted in the main unit, made of an elastic material, and formed with a pressure bearing plate at an upper end, a bottom plate at lower end, and a central tube between the pressure bearing plate and the bottom plate, wherein the pressure bearing plate is adjacent to a lower face of the disk, the bottom plate supported on a portion of the main unit, the central tube is elastically extensible to suck air therein, and the central tube is elastically compressible to squeeze out the air; and a nozzle extending in the connecting pipe from a lower portion of the air cylinder so that the air enters or leaves the air cylinder via the nozzle, and comprising a first end on a side of the annular stop, a second end on another side of the annular stop, and a conical guide formed at the second end and adapted for guiding a bullet that contains projectile.

2. The hand-held cracker snap according to claim 1, wherein the disk is made with an external diameter larger than a diameter of the aperture, the disk comprises a shallow cavity for receiving and hence confining the pressure bearing plate, and the main unit comprises an arc-shaped wall that extends around and hence confines the bottom plate.

3. The hand-held cracker snap according to claim 2, wherein the arc-shaped wall extends a long an arc with a radius R, the arc-shaped wall comprises two ends at a distance L from each other, and L is smaller than 2R.

4. The hand-held cracker snap according to claim 1, further comprising a band connected to the main unit and adapted for wrapping an external article.

5. The hand-held cracker snap according to claim 4, wherein the fastener is a hook-and-loop fastener.

6. The hand-held cracker snap according to claim 1, wherein the main unit comprises:

a body comprising a first semi-tube and first semi-ring formed on an internal face of the first semi-tube; and a base connected to the body and formed with a second semi-tube and second semi-ring on an internal face of the second semi-tube, wherein the first and second semi-tubes are joined together to form the connecting pipe, and the first and second semi-rings are joined together to form the annular restraint.

7. The hand-held cracker snap according to claim 1, wherein the button comprises a first tube extending toward the main unit from the top plate, the suppression disk comprises a second tube extending toward the first tube and an annular rib extending around the second tube, the annular rib is inserted in the press element via the orifice, an external face of the annular rib is adjacent to an internal face of the button, the button is connected to the disk by a bolt inserted in the first and second tubes.

* * * * *